US006761121B2

(12) United States Patent
Kotaki

(10) Patent No.: US 6,761,121 B2
(45) Date of Patent: Jul. 13, 2004

(54) THREAD GUIDE DEVICE FOR SEWING MACHINE

(75) Inventor: Hiroyuki Kotaki, Chofu (JP)

(73) Assignee: Juki Corporation, Tokyo (JP)

( * ) Notice: Subject to any disclaimer, the term of this patent is extended or adjusted under 35 U.S.C. 154(b) by 0 days.

(21) Appl. No.: 10/679,740

(22) Filed: Oct. 6, 2003

(65) Prior Publication Data

US 2004/0065241 A1 Apr. 8, 2004

Related U.S. Application Data

(63) Continuation of application No. 10/160,823, filed on May 30, 2002, now Pat. No. 6,655,306.

(30) Foreign Application Priority Data

May 31, 2001 (JP) ..... 2001-165328

(51) Int. Cl.[7] ..... D05B 87/00
(52) U.S. Cl. ..... 112/225
(58) Field of Search ..... 112/225, 224, 112/302; 223/99

(56) References Cited

U.S. PATENT DOCUMENTS

| | | | | |
|---|---|---|---|---|
| 2,108,474 A | | 2/1938 | Brun et al. | |
| 3,517,631 A | | 6/1970 | Weber | |
| 4,198,915 A | * | 4/1980 | Peterson et al. | 112/225 |
| 4,300,463 A | | 11/1981 | Morimoto | |
| 4,651,660 A | | 3/1987 | Oshima et al. | |
| 4,886,004 A | * | 12/1989 | Ogawa et al. | 112/254 |
| 5,386,791 A | * | 2/1995 | Sato et al. | 112/302 |
| 5,596,940 A | | 1/1997 | Yamada et al. | |
| 6,067,919 A | * | 5/2000 | Shoji | 112/225 |

FOREIGN PATENT DOCUMENTS

| | | |
|---|---|---|
| JP | 11-179084 | 7/1999 |
| JP | 11-267383 | 10/1999 |

* cited by examiner

*Primary Examiner*—Ismael Izaguirre
(74) *Attorney, Agent, or Firm*—Merchant & Gould P.C.

(57) ABSTRACT

A thread guide device for a sewing machine comprises thread transfer means 10 and threading means. The thread transfer means 10 includes a thread holding portion 30 capable of holding an upper thread, and the upper thread is held in an upper thread holding position by the thread holding portion 30 and is thus transferred to the vicinity of a lower needle eye. The threading means inserts, into the needle eye, the upper thread transferred to the vicinity of the needle eye by the thread transfer means 10. Moreover, the thread transfer means 10 includes holding pressure changing means (a transfer cam 19, a holding pressure switching roller 46, a holding pressure switching operating plate 40, a holding pressure switching adjusting plate 42, a holding pressure switching link 43, a holding pressure switching plate 44) for changing the holding pressure of the thread holding portion 30 during transfer in which the upper thread is to be transferred from the thread holding position to the vicinity of the needle eye and during return in which the upper thread is to be transferred to the vicinity of the needle eye and the thread holding portion 30 is to be then returned to the thread holding position.

1 Claim, 11 Drawing Sheets

THREAD GUIDE DEVICE FOR SEWING MACHINE

This application is a continuation of application Ser. No. 10/160,823, filed May 30, 2002, now U.S. Pat. No. 6,655, 306, which application is incorporated herein by reference.

BACKGROUND OF THE INVENTION

1. Field of the Invention

The present invention relates to a thread guide device for a sewing machine comprising thread transfer means for transferring an upper thread to the vicinity of a needle eye, and threading means for inserting, into the needle eye, the upper thread transferred to the vicinity of the needle eye by the thread transfer means.

2. Description of the Related Art

Conventionally, JP-A-11-179084 and JP-A-11-267383 have disclosed a sewing machine comprising an automatic thread guide device for automatically delivering an upper thread to the vicinity of a needle eye and inserting the upper thread through the needle eye, for example.

An embroidering sewing machine described in the JP-A-11-179084 comprises thread delivery means for delivering an upper thread to be overhung from the upper part of the sewing machine to the vicinity of the eye of a sewing needle, and threading means for inserting the upper thread delivered by the thread delivery means into the eye of the sewing needle. The thread delivery means includes a thread delivery arm to be rotated by half, and the thread delivery arm is provided with a thread delivery holding portion for holding the upper thread. The thread delivery arm is rotated by half so that the thread delivery holding portion is reciprocated between the standby position of the upper part of the sewing machine and the vicinity of the sewing needle.

In a thread guiding operation to be carried out until the upper thread is inserted through the eye of the sewing needle, first of all, the upper thread is held by the thread delivery holding portion moved to the standby position of the upper part of the sewing machine so that the upper thread is held. At this time, the holding force of the thread delivery holding portion is reduced such that the upper thread can easily be set.

When the upper thread is held by the thread delivery holding portion, the thread delivery arm is rotated by half and the thread delivery holding portion is moved to the sewing needle with the upper thread held therein. When the thread delivery arm is to be rotated by half, the thread delivery holding portion is set to have great holding force such that the upper thread does not slip off.

When the thread delivery holding portion is moved to such a position that the upper thread is overhung toward the eye of the sewing needle, the upper thread is inserted through the eye of the sewing needle by the threading means. At this time, the thread delivery holding portion has the holding force reduced such that the upper thread can be removed from the thread delivery holding portion after the threading.

Then, the thread delivery arm is rotated reversely so that the thread delivery holding portion is moved from the sewing needle side toward the standby position. Thus, the thread guiding operation of the upper thread is completed.

In the conventional sewing machine, however, holding force of the thread delivery holding portion cannot be changed when the thread delivery arm is rotated by half to move the thread delivery holding portion from the standby position to the vicinity of the sewing needle and to move the thread delivery holding portion from the sewing needle side to the standby position. Therefore, in the case in which the thread remains in the thread delivery holding portion after the threading, there is a possibility that the thread delivery holding portion might strongly hold and pull up a thread and remove the thread from the eye of the sewing needle and the thread cannot be consequently guided with high precision.

Moreover, when the thread delivery holding portion is moved from the standby position to the vicinity of the sewing needle, the holding force of the thread delivery holding portion is reduced. In order to guide the thread with higher precision, it is more preferable that the holding force of the thread delivery holding portion should be properly adjusted into appropriate holding force during upper thread setting or threading.

In order to guide the thread with higher precision, moreover, it is preferable that the stop position of the thread delivery holding portion in the standby position should be placed to reliably set the upper thread into the thread delivery holding portion or the stop position of the thread delivery holding portion in the vicinity of the sewing needle should be placed to carry out the threading well.

SUMMARY OF THE INVENTION

It is an object of the invention to provide a thread guide device for a sewing machine which can carry out a thread guiding operation with higher precision.

In order to attain the object, as shown in FIGS. 1, 2, 9 and 12, for example, a first aspect of the invention is directed to a thread guide device (1) for a sewing machine comprising:

thread transfer means (10) including a thread holding portion (a thread holding portion 30) capable of holding an upper thread and serving to hold the upper thread in a thread holding position by means of the thread holding portion and to transfer the upper thread to the vicinity of a needle eye (N);

threading means (50) for inserting, into the needle eye, the upper thread (A) transferred to the vicinity of the needle eye by the thread transfer means; and holding pressure changing means (a transfer cam 19, a holding pressure switching roller 46, a holding pressure switching operating plate 40, a holding pressure switching adjusting plate 42, a holding pressure switching link 43, a holding pressure switching plate 44) for changing a holding pressure of the thread holding portion during transfer in which the upper thread is to be transferred from the thread holding position to the vicinity of the needle eye and during return in which the thread holding portion is to be returned to the thread holding position after the upper thread is transferred to the vicinity of the needle eye.

According to the first aspect of the invention, the thread guide device for a sewing machine comprises the holding pressure changing means. Therefore, the holding pressure of the thread holding portion can be changed during the transfer in which the upper thread is to be transferred from the thread holding position to the vicinity of the needle eye and during the return in which the upper thread is to be transferred to the vicinity of the needle eye and the thread holding portion is to be then returned to the thread holding position.

Accordingly, it is possible to set that the holding pressure of the thread holding portion is increased during the transfer and the upper thread is prevented from slipping off from the thread holding portion, and the holding pressure of the thread holding portion is reduced during the return and the thread holding portion holds the upper thread without a pull even if the upper thread remains in the thread holding portion after threading. Thus, it is possible to carry out a thread guiding operation with higher precision.

As shown in FIG. 2, for example, a second aspect of the invention is directed to the thread guide device for a sewing machine according to the first aspect of the invention, wherein the thread transfer means includes the thread holding portion and a thread transfer member (20) for reciprocating the thread holding portion between the thread holding position and the vicinity of the needle eye by a rotation, and the holding pressure changing means includes:

a rotor (a transfer cam 19) having two different cams (19*b*, 19*c*) from each other and rotated relatively with respect to the thread transfer member around a rotating shaft (a shaft 18) of the thread transfer member during the rotation of the thread transfer member;

a contact (a holding pressure switching roller 46) provided in the thread transfer member and coming in contact with the cams of the rotor rotated relatively with respect to the thread transfer member; and holding pressure switching means (holding pressure switching operating plate 40, holding pressure switching adjusting plate 42, a holding pressure switching link 43, a holding pressure switching plate 44) for switching the holding pressure of the thread holding portion based on a displacement in a position of the contact which comes in contact with the cams.

According to the second aspect of the invention, the holding pressure changing means includes the rotor, the contact and the holding pressure switching means. Therefore, when the contact comes in contact with the thread transfer member along the cam of the rotor rotated relatively during the rotation of the thread transfer member, the position of the contact is changed so that the holding pressure of the thread holding portion is switched based on a displacement in the position of the contact.

Accordingly, when the thread transfer member is rotated so that the thread holding portion is reciprocated between the thread holding position and the vicinity of the needle eye, the holding pressure of the thread holding portion can be switched.

A third aspect of the invention is directed to the thread guide device for a sewing machine according to the second aspect of the invention, further comprising contact cam switching means (a compression spring 47, a tension spring 48, an inclined portion 19*h*) for switching the cam with which the contact comes in contact when the thread holding portion goes from the thread holding position to the vicinity of the needle eye and when it comes back from the vicinity of the needle eye to the thread holding position.

According to the third aspect of the invention, the thread guide device for a sewing machine comprises the contact cam switching means. Therefore, the cam with which the contact comes in contact is switched when the thread holding portion goes and when it comes back. For this reason, the contact comes in contact with the different cams when the thread holding portion goes and when it comes back. Therefore, the holding pressure to be switched by the holding pressure switching means is varied when the thread holding portion goes and when it comes back. Thus, it is possible to change the holding pressure of the thread holding portion when the thread holding portion goes and when it comes back.

A fourth aspect of the invention is directed to the thread guide device for a sewing machine according to the first aspect of the invention, wherein the thread transfer means includes a thread transfer member having the thread holding portion and supported rotatably, and a rotor capable of being rotated around a rotating shaft of the thread transfer member and capable of being at least partially (a stopper 19*d*) engaged with at least a part (an abutment portion 26*a*) of the thread transfer member, and holding a state in which a rotation is not carried out in engagement with the thread transfer member, thereby stopping the thread holding portion in the thread holding position, the thread guide device further comprising:

engagement position changing means (a positioning plate 26) capable of changing an engagement position of the rotor and the thread transfer member.

According to the fourth aspect of the invention, the thread guide device for a sewing machine comprises the engagement position changing means. Therefore, the engagement position of the rotor and the thread transfer member is changed so that the relative position of the rotor and the thread transfer member in a state in which the rotor is engaged with the thread transfer member can be varied. By holding such a state that the rotor is not rotated in engagement with the thread transfer member, consequently, it is possible to change a position in which the thread holding position stops.

More specifically, it is possible to change the engagement position of the rotor and the thread transfer member, thereby regulating the stop position of the thread holding portion. Consequently, the thread holding portion can be set into such a position that the upper thread can easily be held. Accordingly, it is possible to carry out the thread guiding operation with higher precision.

A fifth aspect of the invention is directed to the thread guide device for a sewing machine according to the second aspect of the invention, wherein the holding pressure switching means is a link device including a plurality of links, and there is provided fulcrum position changing means (a holding pressure switching adjusting plate 42) capable of changing fulcrum positions of the links (a holding pressure switching link 43).

According to the fifth aspect of the invention, the thread guide device for a sewing machine comprises the fulcrum position changing means. Therefore, it is possible to change the fulcrum position of the link of the holding pressure switching means. Consequently, it is possible to vary a degree at which a displacement in the position of the contact is switched into the thread holding pressure. Thus, it is possible to regulate the holding pressure of the thread holding portion in addition to the switching of the holding pressure by the cam of the rotor.

Accordingly, the holding pressure of the thread holding portion can be finely regulated by changing the fulcrum position of the link through the fulcrum position changing means. For example, accordingly, a holding pressure applied during the threading by the threading means can be regulated into a proper holding pressure so that the thread guiding operation can be carried out with higher precision.

A sixth aspect of the invention is directed to the thread guide device for a sewing machine according to the second aspect of the invention, further comprising contact position determining means (a holding pressure switching abutment plate 6) capable of determining, into a different position, a position of the contact in a state in which the thread holding portion of the thread transfer member is moved into a thread holding position.

According to the sixth aspect of the invention, the thread guide device for a sewing machine comprises the contact position determining means. Therefore, it is possible to determine, into a different position, the position of the contact in such a state that the thread holding portion is moved to the thread holding position. Moreover, the holding pressure switching means switches the holding pressure of the thread holding portion based on the position of the contact determined by the contact position determining means.

Accordingly, the position of the contact is determined into the different position by the contact position determining means so that the holding pressure of the thread holding portion in the thread holding position can be regulated into a proper pressure during thread holding. Consequently, it is possible to carry out the thread guiding operation with higher precision.

A seventh aspect of the invention is directed to a thread guide device for a sewing machine comprising thread transfer means including a thread holding portion capable of holding an upper thread and serving to hold the upper thread in a thread holding position by means of the thread holding portion and to transfer the upper thread to the vicinity of a needle eye, and threading means for inserting, into the needle eye, the upper thread transferred to the vicinity of the needle eye by the thread transfer means, wherein the thread transfer means includes a thread transfer member having the thread holding portion and serving to reciprocate the thread holding portion between the thread holding position and the vicinity of the needle eye by a rotation and a regulating member (a regulating cam 5) for regulating the rotation of the thread transfer member, the thread transfer member having a first abutment portion (the other end 28*b*) to abut on the regulating member in the middle in which the thread holding portion goes from the thread holding position to the vicinity of the needle eye, and a second abutment portion (one end 28*a*) to abut on the regulating member in a position which is more distant from a rotating shaft than a distance from an abutment position of the first abutment portion on the regulating member to the rotating shaft of the thread transfer member in a state in which the thread holding portion is moved to the vicinity of the needle eye.

According to the seventh aspect of the invention, the thread transfer member is provided with the first abutment portion and the second abutment portion. Therefore, the portion of the regulating member which abuts on the first abutment portion can have a size reduced, and furthermore, the regulating member abuts on the second abutment portion in a position placed apart from the center of the rotation of the thread transfer member so that the rotation of the thread transfer member can be regulated stably.

Accordingly, the size of the regulating member can be reduced and the stop position of the thread holding portion in the vicinity of the needle eye can be determined with higher precision. Consequently, it is possible to carry out the thread guiding operation with higher precision.

DESCRIPTION OF THE PREFERRED EMBODIMENTS

An embodiment of the invention will be described below in detail with reference to the drawings.

Figure 1:
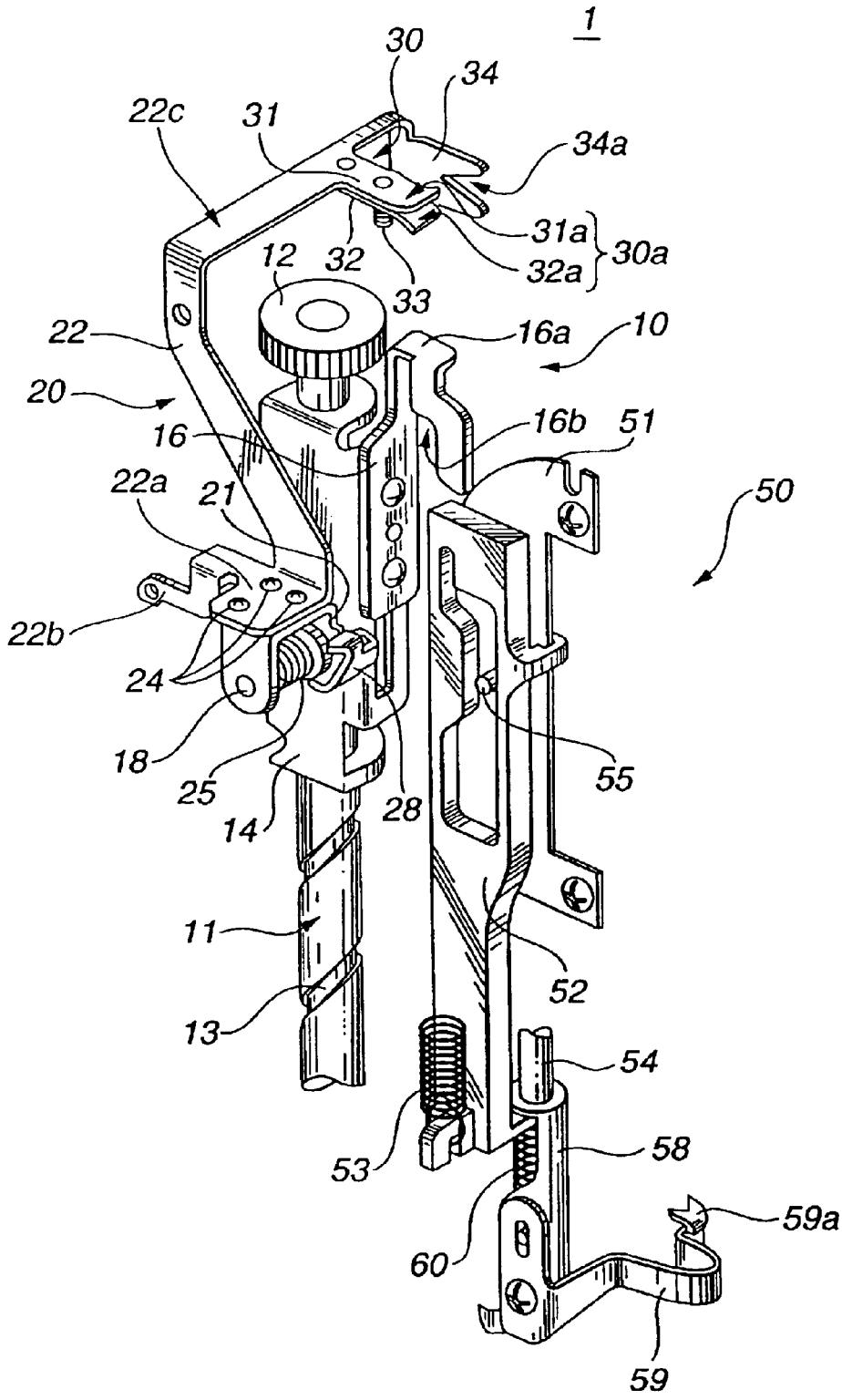
FIG. 1 is a schematic perspective view showing a thread guide device for a sewing machine according to an embodiment to which the invention is applied.

As shown in FIG. 1, a thread guide device 1 for a sewing machine according to the embodiment comprises thread transfer means 10 for transferring an upper thread to the vicinity of the eye of a needle which is not shown, and threading means 50 for inserting, into the needle eye, the upper thread transferred to the vicinity of the needle eye by the thread transfer means 10.

First of all, the structure of the thread transfer means 10 will be described. The thread transfer means 10 includes a thread transfer member 20 which will be described below.

Figure 3:
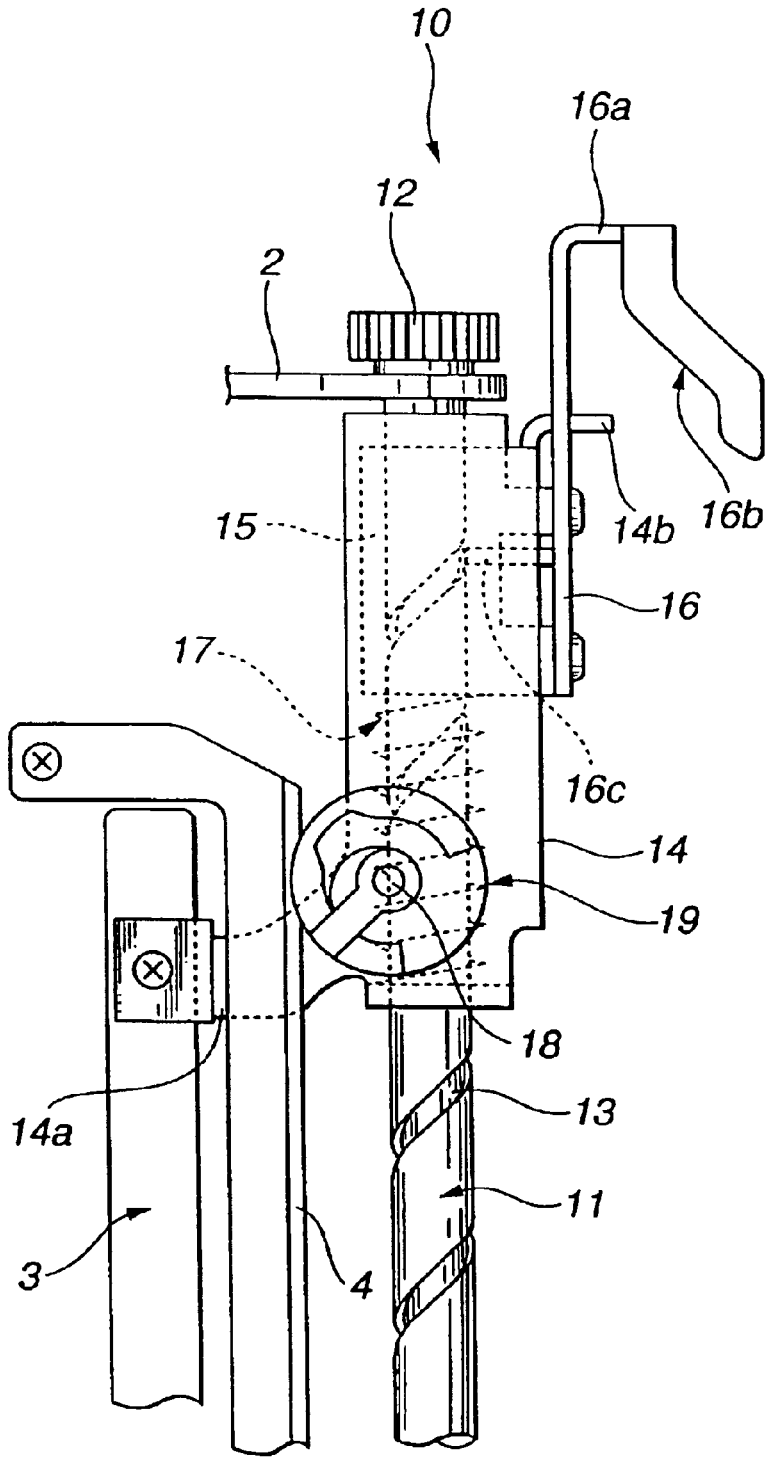
FIG. 3 is a side view showing the main part of the thread transfer means in which a thread transfer member in FIG. 1 is removed.

In the thread transfer means 10, as shown in FIG. 3, a driving shaft 11 is rotatably supported by a table plate 2 of the sewing machine. A driving gear 12 is attached to the upper end of the driving shaft 11. The driving gear 12 is engaged with a gear which is rotated by a stepping motor (not shown) and is not shown. Moreover, a screw groove 13 is formed on the driving shaft 11.

An external operating member 14 taking almost the shape of a box is attached to the driving shaft 11 in a free movement state. An extended portion 14*a* extended rearward (toward left in FIG. 3) is provided on the lower end of the external operating member 14. Moreover, an external operating member guide 3 extended in a vertical direction is provided in the table plate (not shown) of the sewing machine, and the tip of the extended portion 14*a* of the external operating member 14 is slidably fitted in the external operating member guide 3. Consequently, the external operating member 14 is slidable in the vertical direction without a rotation.

Moreover, the upper end of the external operating member 14 is provided with an engaging portion 14*b* to be engaged, from above, with an engaged member 105 (shown in FIG. 9) provided on a needle bar 100 which will be described below.

As shown in FIG. 3, an internal operating member 15 taking almost the shape of a box is provided in the external operating member 14. The internal operating member 15 has such a size that it is movable in the vertical direction in the external operating member 14 and is not rotatable. A threading operating plate 16 is attached to the internal operating member 15.

As shown in FIG. 1, the threading operating plate 16 is provided with an extended portion 16*a* to abut, from above, on a threading operating member 52 which will be described below, and a cam portion 16*b* to abut, from above, on a threading shaft pin 55 of a threading shaft 54 which will be described below.

As shown in FIG. 3, moreover, the threading operating plate 16 is provided with a driving pin 16*c* protruded inwardly into the internal operating member 15 and fitted in the screw groove 13 of the driving shaft 11. Consequently, when the driving shaft 11 is rotated, the internal operating member 15 is moved in the vertical direction without a rotation in the external operating member 14.

A compression spring 17 is provided in the external operating member 14. The compression spring 17 serves to push the bottom face of the external operating member 14 and that of the internal operating member 15 in such a direction that they separate from each other. Consequently, the upper surface of the internal operating member 15 is pushed onto the upper surface of the external operating member 14 from below. When the internal operating member 15 is moved vertically, the external operating member 14 is also moved vertically.

A shaft 18 is protruded from the side surface of the external operating member 14 and a transfer cam (rotor) 19 is rotatably attached to the shaft 18. As shown in FIG. 4, a gear 19*a* is formed on one of the surfaces of the transfer cam 19. The transfer cam 19 is attached to the shaft 18 in such a state that a surface having the gear 19*a* is turned toward the external operating member 14 side.

As shown in FIG. 3, a rack 4 is attached to the table plate (not shown) of the sewing machine in the vertical direction and the gear 19*a* of the transfer cam 19 is engaged with the rack 4. Consequently, the transfer cam 19 is rotated clockwise in FIG. 3 when the external operating member 14 falls down, and the transfer cam 19 is rotated counterclockwise when the external operating member 14 goes up.

Figure 4A:
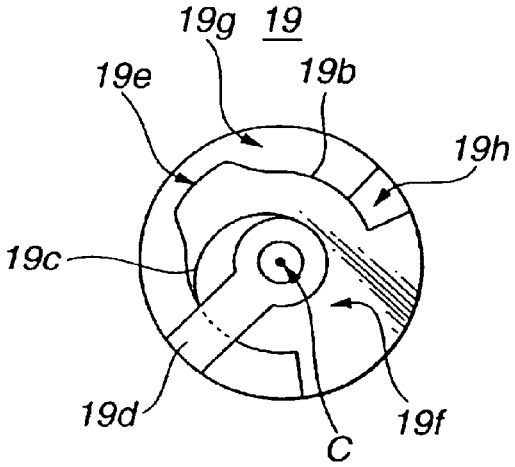
FIG. 4 is a view showing a transfer cam in FIG. 3, (A) being a side view and (B) being a front view.
Figure 4B:
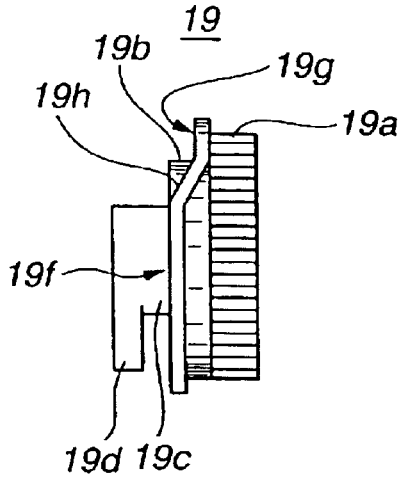

As shown in FIG. 4(B), a cam 19*b*, a cam 19*c* and a stopper 19*d* are provided on the other surface of the transfer cam 19 in order from the gear 19*a*, respectively. As shown in FIG. 4(A), the stopper 19*d* takes such a shape as to be extended from a shaft center C of the transfer cam 19 to the maximum outer peripheral edge of the transfer cam 19 in one direction. Moreover, a distance from the shaft center C to the outer peripheral edge of the cam 19*c* is gradually increased in a counterclockwise direction in FIG. 4.

Moreover, an outward protruded cam 19*e* is provided on the outer peripheral edge of the cam 19*b*. A distance from the shaft center C to the outer peripheral edge of the cam 19*b* is set to be almost equal to the longest distance from the shaft center C to the outer peripheral edge of the cam 19*c* in portions other than the portion in which the protruded cam 19*e* is provided.

Furthermore, the transfer cam 19 is provided with an inclined portion 19*h* inclined from a cam face 19*g* of the cam 19*b* toward a cam face 19*f* of the am 19*c*.

Figure 2:
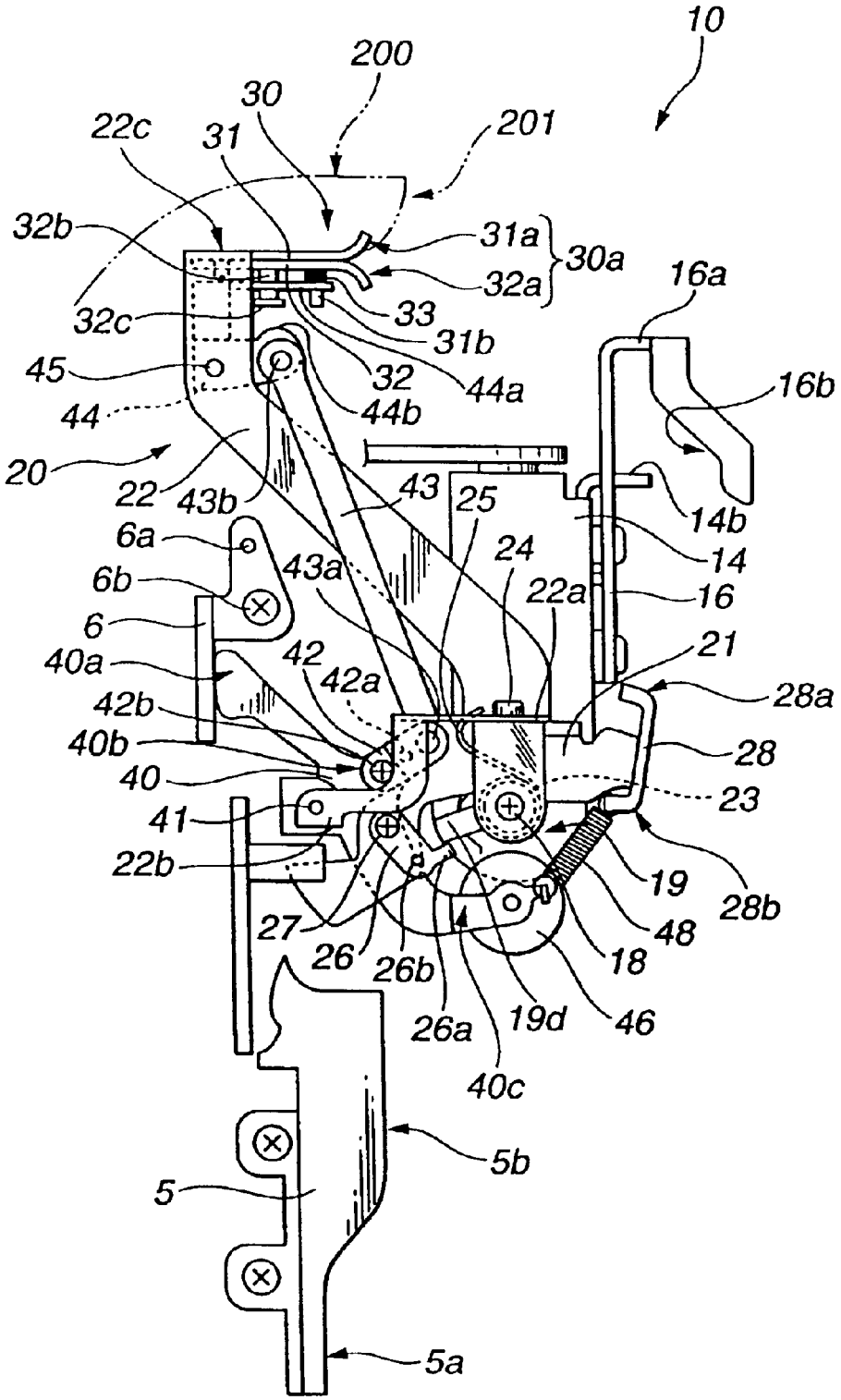
FIG. 2 is a side view showing the main part of thread transfer means in FIG. 1.

As shown in FIGS. 1 and 2, a thread transfer member 20 is rotatably attached to the shaft 18 on the outside of a position in which the transfer cam 19 is attached. In FIG. 3, the thread transfer member 20 is not shown. As shown in FIG. 2, the thread transfer member 20 includes a thread transfer member base portion 21 attached rotatably through a collar 23 fixed to the shaft 18, and a thread transfer member arm portion 22 having a base end 22*a* fixed to the thread transfer member base portion 21 with a screw 24.

A torsion spring 25 is hung on the thread transfer member base portion 21 and the color 23. Consequently, the thread transfer member 20 is energized around the shaft 18 clockwise in FIG. 2. Moreover, a positioning plate (engagement position changing means) 26 is fixed to the thread transfer member base portion 21 with a screw 27. An abutment portion 26*a* protruded toward the shaft 18 side is provided on one end side of the positioning plate 26.

Consequently, the abutment portion 26*a* is pushed against the stopper 19*d* of the transfer cam 19 by the energizing force of the torsion spring 25 so that the thread transfer member 20 is engaged with the transfer cam 19. Accordingly, when the transfer cam 19 is rotated in this state, the thread transfer member 20 is also rotated correspondingly.

A boss 26*b* protruded toward the thread transfer member base portion 21 side is provided on one end side of the positioning plate 26. The boss 26*b* is rotatably fitted in a hole which is formed in the thread transfer member base portion 21 and is not shown. Moreover, a larger hole (not shown) than the axial diameter of the screw 27 is formed on the other end of the positioning plate 26.

Consequently, the positioning plate 26 is rotated around the boss 26*b* with respect to the thread transfer member base portion 21, and the fixing position of the positioning plate 26 with the screw 27 is thereby changed. Consequently, it is possible to finely adjust the engagement position of the abutment portion 26*a* and the stopper 19*d*.

Moreover, a U-shaped cam abutment portion 28 is formed on the thread transfer member base portion 21. The shape of the cam abutment portion 28 is set such that one end 28*a* of the cam abutment portion 28 has a greater distance from the shaft 18 than the other end 28*b*. Moreover, a regulating cam (a regulating member) 5 for regulating the rotation of the thread transfer member 20 is fixed to a frame which is not shown.

Figure 6A:
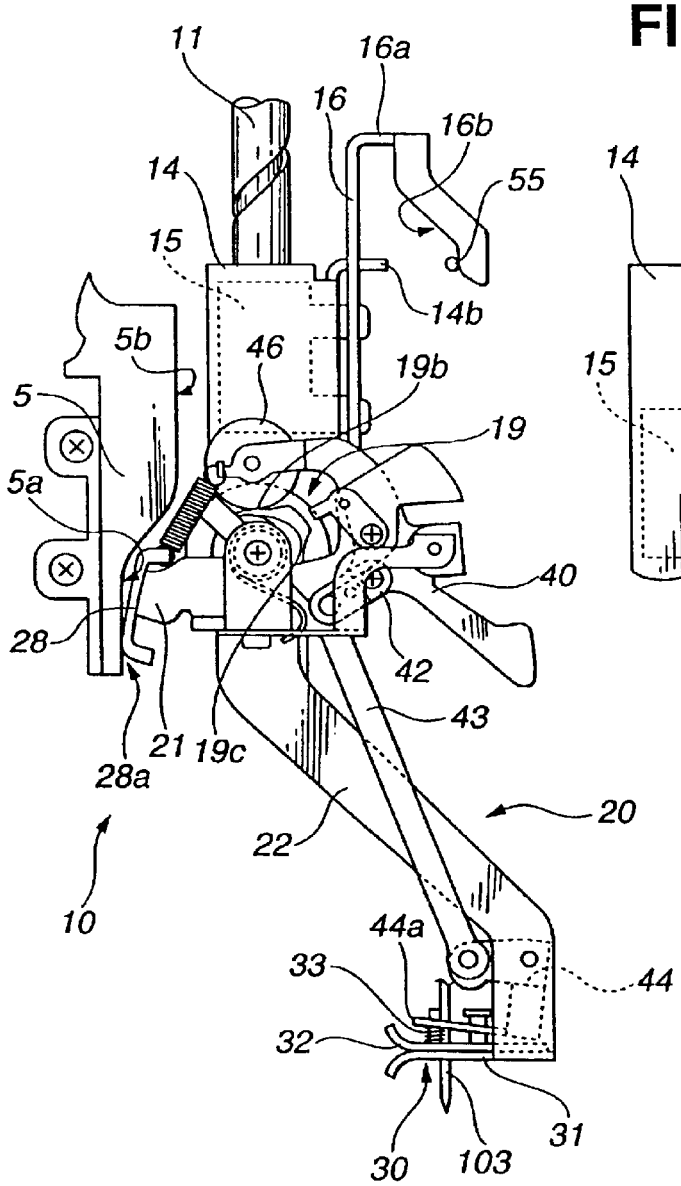
FIG. 6(A) is a side view showing the thread transfer means in a state in which a thread holding portion in FIG. 1 is moved to the front of a needle eye and FIG. 6(B) is a side view showing a state in which an internal operating member falls down with respect to an external operating member.
Figure 9:
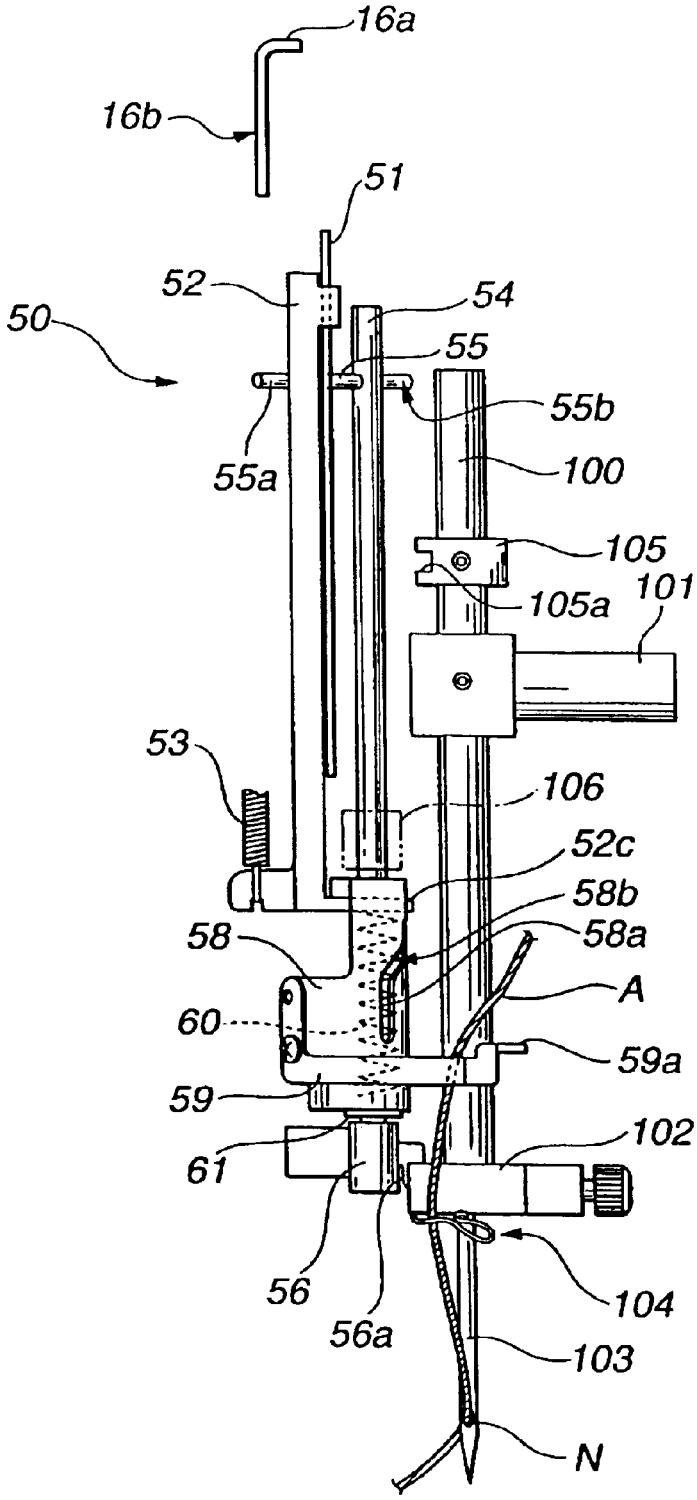
FIG. 9 is a front view showing the threading means and a needle bar in FIG. 1.

In a state in which the engaging portion 14*b* of the external operating member 14 abuts on the engaged member 105 shown in FIG. 9 (which is shown in FIG. 6(A)), one end (a second abutment portion) 28*a* of the cam abutment portion 28 abuts on a cam portion 5*a* formed in the lower part of the regulating cam 5. In a state in which the engaging portion 14*b* of the external operating member 14 is placed in a slightly higher position than the engaged member 105 (shown in FIG. 7), moreover, the other end (a first abutment portion) 28*b* of the cam abutment portion 28 abuts on a cam portion 5*b* formed in the upper part of the regulating cam 5.

The cam portions 5*a* and 5*b* of the regulating cam 5 have attachment positions and shapes set in such a manner that the thread transfer member 20 does not come in contact with other members in the sewing machine when it is moved vertically in a state in which the cam abutment portion 28 abuts on the cam portions 5*a* and 5*b* of the regulating cam 5. Moreover, the cam portion 5*b* is formed almost rectilinearly. In a state in which the end 28*b* of the cam abutment portion 28 abuts on the cam portion 5*b*, consequently, the thread transfer member 20 is moved vertically with the inclination of the thread transfer member 20 held in a constant direction.

Moreover, the attachment position of the regulating cam 5 is set such that an upper thread stretched over a thread holding portion 30 provided on a tip portion 22*c* of a thread transfer member arm portion 22 and a thread guide portion 34 (which will be described below) is pushed toward a needle eye N of a needle 103 in a state in which the end 28*a* of the abutment portion 28 abuts on the cam portion 5*a*.

As shown in FIG. 1, the tip portion 22*c* of the thread transfer member arm portion 22 is provided with the thread holding portion (thread holding portion) 30 for holding the upper thread and the thread guide portion 34 for guiding and supporting the upper thread.

The thread holding portion 30 includes a fixing plate 31 provided integrally with the thread transfer member arm portion 22, and a pressing plate 32 pushed against the fixing plate 31 by means of a compression spring 33 from below. A tip portion 31*a* of the fixing plate 31 and a tip portion 32*a* of the pressing plate 32 take such warped shapes as to separate from each other, and a thread inlet 30*a* for guiding the upper thread between the fixing plate 31 and the pressing plate 32 is constituted by the tip portions 31*a* and 32*a*.

As shown in FIG. 2, a shaft 31*b* extended toward the shaft 18 side is provided on the fixing plate 31. The shaft 31*b* penetrates through the pressing plate 32 and one end 44*a* of a holding pressure switching plate 44 which will be described below. The compression spring 33 is attached to the shaft 3*b* between the pressing plate 32 and the end 44*a*.

Moreover, the pressing plate 32 is provided with a shaft 32*b* extended toward the shaft 18 side. The shaft 32*b* penetrates through the end 44*a* of the holding pressure switching plate 44. A contact 32*c* is provided on the tip of the shaft 32*b* such that the shaft 32*b* does not slip off from the end 44*a* when the end 44*a* is moved in such a direction as to separate from the pressing plate 32.

As shown in FIG. 1, the tip of the thread guide portion 34 is provided with a V-shaped groove 34*a* having such a shape as to be opened in the same direction as the opening direction of the thread inlet 30*a* of the thread holding portion 30. The V-shaped groove 34*a* is formed in a position having an almost equal height to that of the lower surface of the fixing plate 31 in the thread holding portion 30.

In FIG. 2, a rear panel 200 of the sewing machine is shown in a virtual line. The edge portion of the rear panel 200 acts as a thread guide groove 201 for guiding the upper thread. The upper thread led from a thread piece provided in the sewing machine which is not shown is moved along the thread guide groove 201 so that the upper thread can be set to be stretched between the thread inlet 30*a* of the thread holding portion 30 and the V-shaped groove 34*a* of the thread guide portion 34.

The base end 22*a* of the thread transfer member arm portion 22 is provided with an extended portion 22*b* extended in such a direction as to separate from the shaft 18. As shown in FIG. 2, a holding pressure switching operating plate 40 formed to have an almost three-forked shape is rotatably attached to the extended portion 22*b* through a shaft 41. The holding pressure switching operating plate 40 has one end 40*a* attached in such a direction as to separate from the shaft 18 between the base end 22*a* of the thread transfer member arm portion 22 and the tip of the extended portion 22*b*.

A holding pressure switching adjusting plate (fulcrum position changing means) 42 is fixed with a screw 42*b* to a middle portion 40*b* of the holding pressure switching operating plate 40. One of the ends of a holding pressure switching link 43 is rotatably attached to one of the ends of the holding pressure switching adjusting plate 42 with a shaft 43*a*.

A boss 42*a* protruded toward the holding pressure switching operating plate 40 side is provided on the holding pressure switching adjusting plate 42. The boss 42*a* is rotatably fitted in a hole which is formed on the holding pressure switching operating plate 40 and is not shown. Consequently, the holding pressure switching adjusting plate 42 is rotated around the boss 42*a* with respect to the holding pressure switching operating plate 40, thereby changing the fixing position of the holding pressure switching adjusting plate 42 with the screw 42*b*. Consequently, the position of the shaft 43*a* of the holding pressure switching link 43, that is, the position of a fulcrum can be adjusted finely.

Moreover, a holding pressure switching plate 44 is rotatably attached to the thread transfer member arm portion 22 in a middle part thereof with a shaft 45. The other end of the holding pressure switching link 43 is rotatably attached to the other end 44*b* of the holding pressure switching plate 44.

Figure 5A:
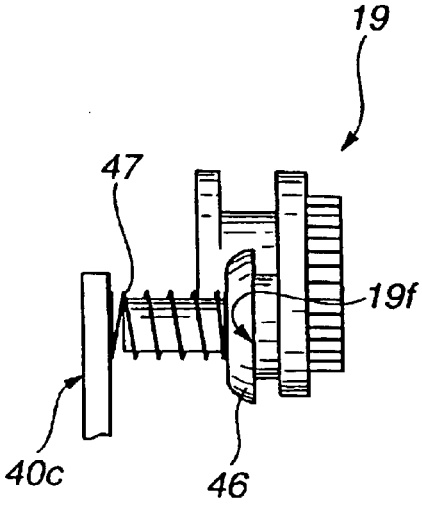
FIG. 5 is a view for explaining the positional relationship between the transfer cam and a holding pressure switching roller in FIG. 2, (A) being a front view showing a state in which the holding pressure switching roller abuts on a cam face 19*f* and (B) being a front view showing a state in which the holding pressure switching roller abuts on a cam face 19*g*.
Figure 5B:
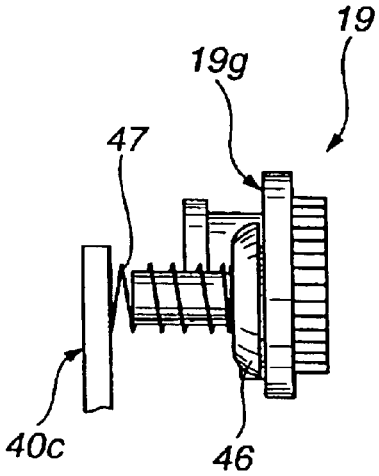

Moreover, a holding pressure switching roller (a contact) 46 is provided on the other end 40*c* of the holding pressure switching operating plate 40. As shown in FIG. 5, the holding pressure switching roller 46 is rotatably supported by a compression spring 47 and is pushed against the transfer cam 19 side, thereby abutting on the cam faces 19*f* and 19*g*.

As shown in FIG. 2, moreover, the other end 40*c* of the holding pressure switching operating plate 40 is connected to the cam abutment portion 28 through a tension spring 48 to be pulled against each other in such a direction as to approach each other. More specifically, the holding pressure switching operating plate 40 is energized around the shaft 41 counterclockwise in FIG. 2.

In the case in which the holding pressure switching roller 46 is pulled by means of the tension spring 48 to approach the shaft 18 side, the holding pressure switching operating plate 40 is rotated counterclockwise and the shaft 43*a* of the holding pressure switching link 43 is caused to approach the shaft 45 of the holding pressure switching plate 44. Consequently, the holding pressure switching plate 44 is rotated through the holding pressure switching link 43 counterclockwise in FIG. 2, and one end 44*a* is caused to approach the fixing plate 31 so that the compression spring 33 is more compressed. Accordingly, force for pushing the pressing plate 32 against the fixing plate 31 (the holding pressure of the thread holding portion 30) is increased.

On the other hand, in the case in which the holding pressure switching roller 46 is kept away from the shaft 18 side outward against the tensile force of the tension spring 48, the holding pressure switching operating plate 40 is rotated clockwise so that the shaft 43*a* of the holding pressure switching link 43 is kept away from the shaft 45 of the holding pressure switching plate 44. Consequently, the holding pressure switching plate 44 is rotated in a clockwise direction and the end 44*a* is separated from the fixing plate 31 so that the compression of the compression spring 33 is reduced. Accordingly, the holding pressure of the thread holding portion 30 is reduced.

More specifically, the holding pressure switching operating plate 40, the holding pressure switching link 43 and the holding pressure switching plate 44 are holding pressure switching means for switching the holding pressure of the thread holding portion 30 based on a displacement in the position of the holding pressure switching roller 46.

Moreover, a holding pressure switching abutment plate (contact position determining means) 6 for regulating the movement of the end 40*a* of the holding pressure switching operating plate 40 is fixed with a screw 6*b* to the sewing machine frame which is not shown. In a state in which the internal operating member 15 is moved to the highest position by the driving shaft 11 and is stopped therein (as shown in FIG. 2), the movement of the end 40*a* of the holding pressure switching operating plate 40 is regulated against the tensile force of the tension spring 48. Consequently, a state in which the holding pressure switching roller 46 is stopped in a position placed apart from the outer peripheral edge of the cam 19*c* of the transfer cam 19 is held.

A boss 6*a* is provided on the upper end of a holding pressure switching abutment plate 6 and is rotatably fitted in a hole provided on the sewing machine frame which is not shown. Moreover, a larger hole (not shown) than the axial diameter of the screw 6*b* is formed on the lower part of the boss 6*a* and the screw 6*b* is inserted into the hole for fixation.

Consequently, the holding pressure switching abutment plate 6 is rotated around the boss 6*a* with respect to the sewing machine frame, thereby changing the fixing position of the holding pressure switching abutment plate 6 with the screw 6*b*. Consequently, it is possible to finely adjust the stop position of the end 40*a* of the holding pressure switching operating plate 40, that is, the stop position of the holding pressure switching roller 46.

Next, the structure of the threading means 50 will be described. The threading means 50 includes a threading operating member 52, a threading shaft 54 and a needle damp thread guiding member 58 which will be described below.

As shown in FIG. 9, the threading means 50 is provided adjacently to a needle bar 100. The needle bar 100 is slidably attached to a rocking table which is not shown. Moreover, the needle bar 100 is supported by a needle bar holder 101 and the rotating force of an upper shaft which is not shown transmits a vertical motion to the needle bar 100 through a crank which is not shown.

A needle 103 is attached to the lower end of the needle bar 100 by means of a needle clamp 102. A needle clamp thread guide 104 to be a thread guide for the upper thread is provided on the lower surface of the needle clamp 102. Moreover, an engaged member 105 is screwed into the needle bar 100 above the fixing position of the needle bar holder 101.

Figure 8:
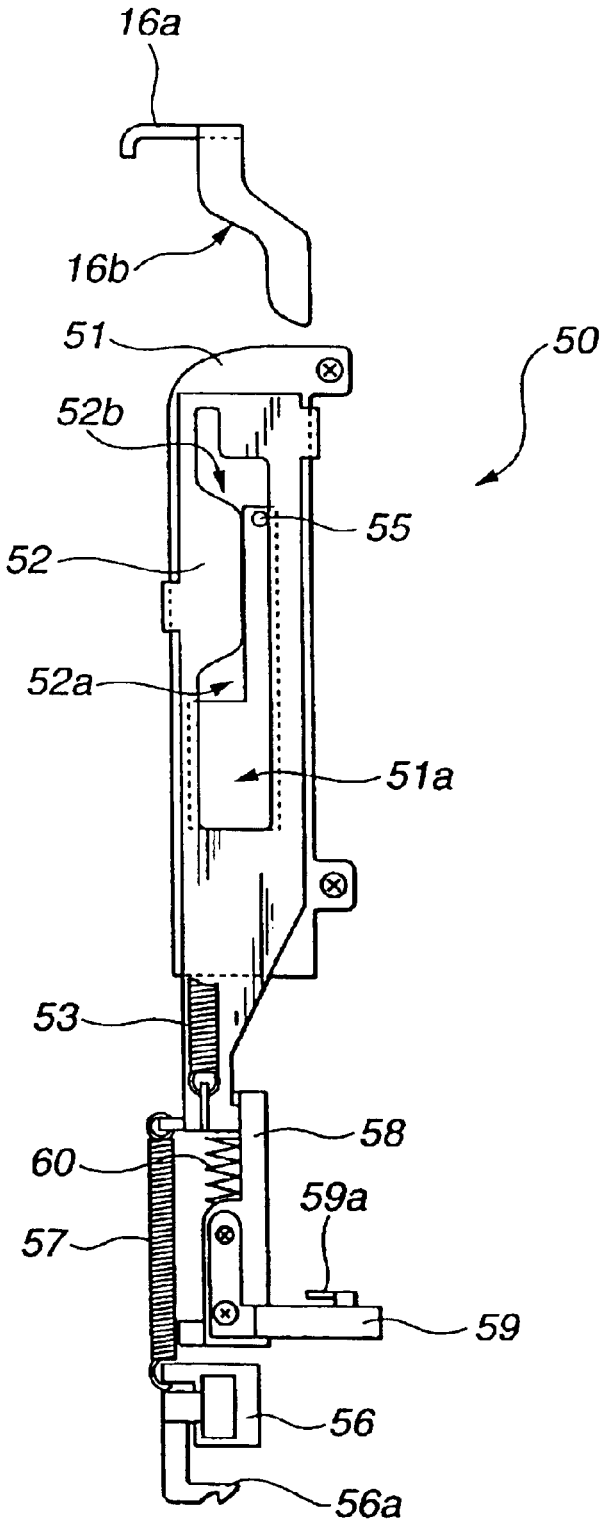
FIG. 8 is a schematic side view showing threading means in FIG. 1.

In the threading means 50, a threading operating member guide 51 is fixed to the rocking member which is not shown, and the threading operating member 52 is attached to the threading operating member guide 51 slidably in the vertical direction. As shown in FIG. 8, holes 51*a* and 52*a* are opened on the threading operating member 52 and the threading operating member guide 51, respectively. The hole 52*a* of the threading operating member 52 is provided with a cam 52*b* to abut on the threading shaft pin 55 which will be described below.

A tension spring 53 is connected to the lower end of the threading operating member 52. Consequently, the threading operating member 52 is pulled upward. Moreover, the extended portion 16*a* of the threading operating plate 16 attached to the internal operating member 15 abuts on the upper surface of the threading operating member 52. When the internal operating member 15 further falls down in this state, the threading operating member 52 is pushed downward against the tensile force of the tension spring 53 by means of the extended portion 16*a* and falls down together with the internal operating member 15.

As shown in FIG. 9, the threading shaft 54 is inserted in the lower end of the threading operating member 52 rotatably and slidably in the vertical direction. The threading shaft 54 is also inserted in a rocking member 106 rotatably and slidably in the vertical direction in almost parallel with the needle bar 100. The threading shaft pin 55 is attached to penetrate through the upper end of the threading shaft 54.

One end 55*a* of the threading shaft pin 55 is inserted in the hole 51*a* of the threading operating member guide 51 and the hole 52*a* of the threading operating member 52. Moreover, the other end 55*b* of the threading shaft pin 55 is caused to abut, from above, on an abutment surface 105*a* of the engaged member 105 fixed to the needle bar 100 when the threading shaft 54 falls down.

A threading hook holder 56 is attached to the lower end of the threading shaft 54. A threading hook 56*a* to be inserted in the needle eye N is attached to the threading hook holder 56.

Moreover, the almost cylindrical needle clamp thread guiding member 58 is rotatably attached to the threading shaft 54. A groove cam 58*a* is formed in the needle clamp thread guiding member 58, and a pin 52*c* provided on the lower end of the threading operating member 52 is slidably fitted in the groove cam 58*a*. The groove cam 58*a* is provided with an inclined cam 58*b* inclined downward.

Moreover, a thread guiding arm 59 is attached to the needle clamp thread guiding member 58. The tip of the thread guiding arm 59 is provided with a forked portion 59*a* for catching the upper thread transferred from above.

As shown in FIG. 8, the threading hook holder 56 is connected to the lower end of the threading operating member 52 through a tension spring 57 so as to be pulled against each other. In FIG. 8, the threading shaft 54 is not shown. Moreover, a compression spring 60 for pushing the bottom portion of the needle clamp thread guiding member 58 and the lower surface of the threading operating member 52 in such a direction as to separate from each other is provided in the needle clamp thread guiding member 58. Moreover, the downward movement of the needle clamp thread guiding member 58 is regulated by means of an E ring 61 fixed to the threading shaft 54.

Consequently, the bottom face of the needle clamp thread guiding member 58 is pushed toward the E ring 61 from above. Therefore, when the threading operating member 52 is moved vertically, the needle clamp thread guiding member 58 and the threading shaft 54 are correspondingly moved vertically.

In a state in which the threading shaft 54 falls down so that the other end 55*b* of the threading shaft pin 55 abuts on the abutment surface 105*a* of the engaged member 105 (shown in FIG. 12), the attachment positions of the threading hook holder 56 and the needle damp thread guiding member 58 are set in such a manner that the threading hook 56*a* is stopped on the level with the needle eye N and the forked portion 59*a* of the thread guiding arm 59 is positioned before an upper thread A stretched from above.

Next, description will be given to a thread guiding operation for transferring the upper shaft to the vicinity of the needle eye N and threading the needle eye N by the thread guide device 1 for a sewing machine.

Before the thread guiding operation, the attachment positions of the positioning plate 26, the holding pressure switching abutment plate 6 and the holding pressure switching adjusting plate 42 are previously adjusted, respectively.

More specifically, the direction of the positioning plate 26 is adjusted and is fixed to the thread transfer member base portion 21 with the screw 27 in such a manner that the directions of the tip portions 31*a* and 32*a* of the fixing plate 31 and the pressing plate 32 in the thread holding portion 30 are not inclined but set to be proper toward the thread guide groove 201 in a state in which the internal operating member 15 is moved and stopped in the highest position (FIG. 2).

Moreover, the direction of the holding pressure switching abutment plate 6 is adjusted and is fixed with the screw 6*b* to the sewing machine frame which is not shown in such a manner that the upper thread is easily led between the fixing plate 31 and the pressing plate 32 in the thread holding portion 30 and a holding pressure at which the upper thread cannot easily slip off can be applied when the upper thread once enters the portion between the fixing plate 31 and the pressing plate 32 in a state in which the internal operating member 15 is moved and stopped in the highest position (FIG. 2).

Furthermore, the direction of the holding pressure switching adjusting plate 42 is regulated and is fixed to the thread transfer member base portion 21 with the screw 42*b* in such a manner that the upper thread A stretched before the needle eye N by the thread holding portion 30 and the thread guide portion 34 as shown in FIG. 10 is not pushed against the threading hook 56*a* entering the needle eye N to get free and a holding pressure at which the threading hook 56*a* catches the upper thread A and pulls the upper thread A into the needle eye N is applied in a state in which the external operating member 14 falls down and the engaging portion 14*b* of the external operating member 14 abuts on the engaged member 105 (FIG. 6).

Moreover, the driving shaft 11 is previously driven by a stepping motor which is not shown and the internal operating member 15 is thus moved and stopped in the highest position, and the thread holding portion 30 is caused to stand by in the thread holding position (thread holding position) of the upper part of the sewing machine.

When the upper thread is to be guided, first of all, an operator pulls out the upper thread from the thread piece (not shown) which is provided in the sewing machine and moves the upper thread along the thread guide groove 201. Consequently, the upper thread is led to the V-shaped groove 34*a* of the thread guide portion 34 and the thread holding portion 30, and the upper thread is then cut to have a predetermined length by means of a thread cutting blade which is not shown.

Thus, the upper thread is held to be stretched between the thread guide portion 34 and the thread holding portion 30 by means of the thread guide portion 34 and the thread holding portion 30.

Since the attachment positions of the positioning plate 26 and the holding pressure switching abutment plate 6 are adjusted as described above, the upper thread moved along the thread guiding groove 201 is reliably led into the thread inlet 30*a* of the thread holding portion 30, enters the portion between the fixing plate 31 and the pressing plate 32 and is thus held by the thread holding portion 30 at a proper holding pressure.

After the upper thread is held by the thread holding portion 30, the operator manipulates a thread guide starting switch which is provided in the sewing machine and is not shown. Consequently, the driving gear 12 is rotated by the stepping motor which is not shown so that the driving shaft 11 is rotated. Thus, the driving pin 16*c* provided in the internal operating member 15 falls down along the screw groove 13 of the driving shaft 11 so that the internal operating member 15 and the external operating member 14 fall down together.

With the fall of the external operating member 14, the transfer cam 19 having the gear 19*a* engaged with the rack 4 is rotated clockwise in FIGS. 2 and 3. Since the abutment portion 26*a* of the positioning plate 26 is pushed against the stopper 19*d* of the transfer cam 19 and abuts thereon by means of the torsion spring 25, the thread transfer member 20 with the upper thread held by the thread holding portion 30 is rotated clockwise with the rotation of the transfer cam 19.

Furthermore, when the internal operating member 15 falls down, the extended portion 16*a* of the threading operating plate 16 abuts on the upper surface of the threading operating member 52. When the internal operating member 15 further falls down in this state, the threading operating member 52 falls down against the upward pulling force of the tension spring 53 and the threading shaft 54 and the needle clamp threading member 58 also fall down correspondingly.

When the thread transfer member 20 falls down with a rotation, the end 40*a* of the holding pressure switching operating plate 40 is separated from the holding pressure switching abutment plate 6. At this time, the holding pressure switching operating plate 40 is rotated counterclockwise in FIG. 2 by the tensile force of the tension spring 48 so that the holding pressure switching roller 46 abuts on the outer peripheral edge of the cam 19*c*.

The holding pressure switching roller 46 is thus caused to approach the shaft 18 side so that the positions of the holding pressure switching operating plate 40, the holding pressure switching adjusting plate 42, the holding pressure switching link 43 and the holding pressure switching plate 44 are moved. Consequently, the compression spring 33 is strongly compressed and the holding pressure of the thread holding portion 30 is thus increased. For this reason, the upper thread is strongly held by the thread holding portion 30 without slip-off.

Furthermore, when the internal operating member 15 falls down, the other end 28*b* of the cam abutment portion 28 in the thread transfer member base portion 21 abuts on the cam portion 5*b* of the regulating cam 5 and is pushed against the regulating cam 5 by the energizing force of the torsion spring 25. Consequently, the rotation of the thread transfer member 20 is regulated. Moreover, since the internal operating member 15 and the external operating member 14 further fall down, the thread transfer member 20 falls down along the regulating cam 5, and furthermore, the transfer cam 19 is continuously rotated.

Consequently, the abutment portion 26*a* of the positioning plate 26 provided in the thread transfer member base portion 21 is separated from the stopper 19*d* and the transfer cam 19 is rotated relatively with respect to the thread transfer member 20. Consequently, the holding pressure switching roller 46 is moved along the outer peripheral edge of the rotated cam 19*c*.

The cam 19*c* is formed to gradually increase a distance from the shaft center C to the outer peripheral edge in a counterclockwise direction. Therefore, when the transfer cam 19 is rotated clockwise, the position of the holding pressure switching roller 46 is moved in such a direction as to go away from the shaft 18. When the holding pressure switching roller 46 is moved to a portion in which the cam 19*c* and the outer peripheral edge of the cam 19*b* are superposed, the holding pressure switching roller 46 is moved from the cam face 19*f* to the cam face 19*g* by means of the compression spring 47. In other words, the compression spring 47 is contact cam switching means for switching the cam with which the holding pressure switching roller 46 comes in contact.

Furthermore, when the internal operating member 15 and the external operating member 14 fall down, the engaging portion 14*b* of the external operating member 14 abuts on the engaged member 105 so that the fall of the external operating member 14 is stopped (FIG. 6(A)). At this time, the upper thread stretched by the thread holding portion 30 and the thread guide portion 34 is stretched before the needle eye N of the needle 103, and the upper thread transferred from above is stretched before the needle damp 102. In this state, the holding pressure switching roller 46 abuts on the outer peripheral edge of the cam 19*b*.

Since the attachment position of the holding pressure switching adjusting plate 42 is regulated as described above, the thread holding portion 30 has a suitable holding pressure for threading. At this time, moreover, the end 28*a* of the cam abutment portion 28 of the thread transfer member base portion 21 abuts on the cam portion 5*a* of the regulating cam 5.

Furthermore, when the driving shaft 11 is rotated, the internal operating member 15 falls down while flexing the compression spring 17 in the external operating member 14 and the threading operating member 52, the threading shaft 54 and the needle clamp thread guiding member 58 correspondingly fall down.

Figure 12:
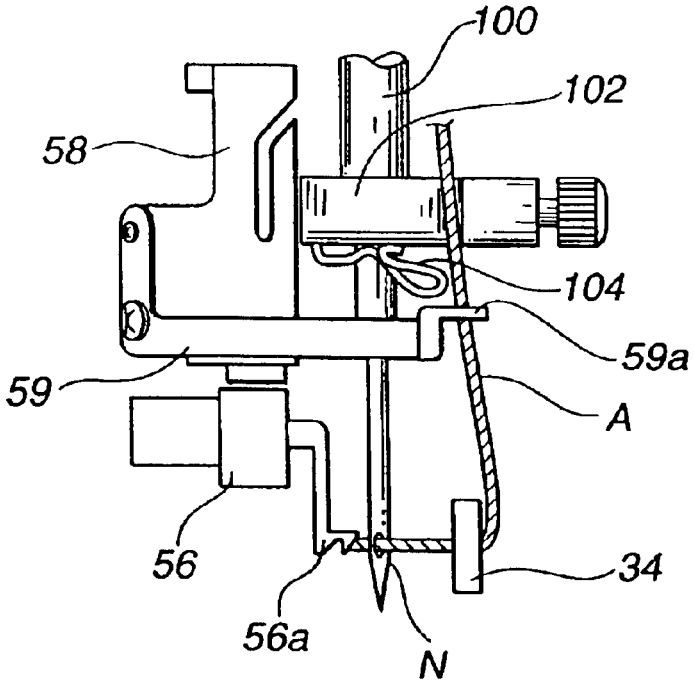
FIG. 12 is a front view showing a main part for explaining the positional relationship among a needle damp, a needle, the needle damp thread guiding member and a threading hook in a state in which the fall of a threading shaft in FIG. 9 is stopped.

When the end 55*a* of the threading shaft pin 55 in the falling threading shaft 54 abuts on the abutment surface 105*a* of the engaged member 105 from above, the fall of the threading shaft 54 is stopped, and furthermore, the fall of the needle clamp thread guiding member 58 is also stopped. At this time, as shown in FIG. 12, the threading hook 56*a* is stopped on the level with the needle eye N and the forked portion 59*a* of the needle clamp thread guiding arm 59 is stopped in front of the upper thread A stretched before the needle damp 102.

Furthermore, when the internal operating member 15 falls down, the threading operating member 52 correspondingly falls down while flexing the compression spring 60 in the needle damp thread guiding member 58. Consequently, the pin 52*c* provided on the lower end of the threading operating member 52 is moved downward along the groove cam 58*a* of the needle damp thread guiding member 58.

Figure 11A:
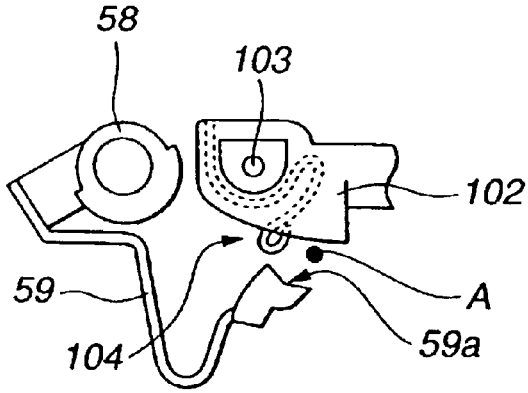
FIG. 11 is a schematic plan view for explaining the operation of a needle clamp thread guiding member in FIG. 8.

The moving direction of the threading operating member 52 is regulated into the vertical direction by means of the threading operating member guide 51. Therefore, when the pin 52*c* falls down in the inclined cam 58*b*, the needle damp thread guiding member 58 is rotated counterclockwise in FIG. 11. Consequently, the upper thread A stretched before the needle damp 102 is caught upon the needle damp thread guide 104 and is led into the needle clamp thread guide 104.

Figure 6B:
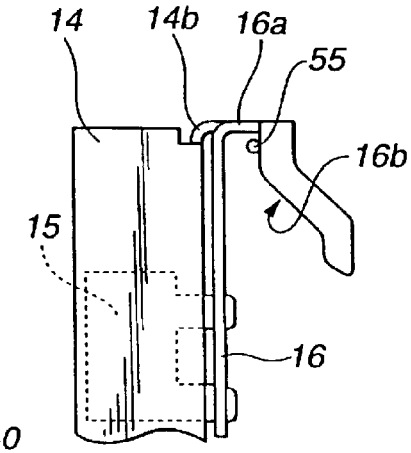

Almost simultaneously with the start of the rotation of the needle clamp thread guiding member 58, moreover, the cam portion 16*b* of the threading operating plate 16 attached to the internal operating member 15 abuts on the end of the threading shaft pin 55 from above as shown in FIG. 6(A). In this state, the internal operating member 15 further falls down and the other end of the threading shaft pin 55 abuts on the abutment surface 105*a* of the engaged member 105. Therefore, the threading shaft pin 55 is moved rearward (to left in FIG. 6) along the cam portion 16*b* (as shown in FIG. 6(B)). Consequently, the threading shaft 54 is rotated.

Figures 10A, 10B, 10C:
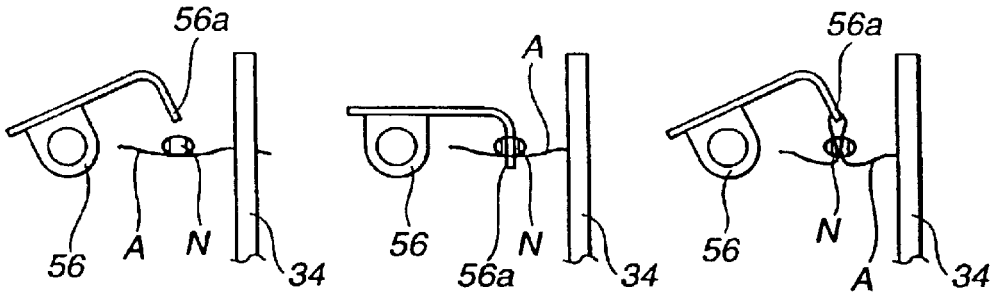
FIG. 10 is a schematic plan view for explaining the operation of a threading hook holder in FIG. 8.

As a result, the threading hook holder 56 provided on the lower end of the threading shaft 54 is also rotated and a state shown in FIG. 10(A) is changed into a state shown in FIG. 10(B). Consequently, the threading hook 56*a* is inserted in the needle eye N and the tip of the threading hook 56*a* is caught upon the upper thread A stretched before the needle eye N.

After the driving shaft 11 is rotated in a predetermined amount by means of the stepping motor, the stepping motor reversely rotates the driving shaft 11. Consequently, the internal operating member 15 is started to go up. Moreover, the threading operating member 52 is energized over the extended portion 16*a* of the internal operating member 15 by the pull-up force of the tension spring 53. Therefore, when the internal operating member 15 goes up, the threading operating member 52 also goes up.

At this time, the external operating member 14 is pushed downward by the compression spring 17. Therefore, the engaging portion 14*b* is stopped in abutment on the engaged member 105. Moreover, the threading shaft 54 is also pushed downward by the compression spring 60 provided in the needle damp thread guiding member 58. Therefore, the threading shaft pin 55 is stopped in abutment on the abutment surface 105*a* of the engaged member 105.

Consequently, the end 55*a* of the threading shaft pin 55 abuts on the cam 52*b* of the threading operating member 52 which is going up. Therefore, when the threading operating member 52 goes up, the threading shaft pin 55 is moved to right in FIG. 8 along the cam 52*b*. Thus, the threading shaft 54 is reversely rotated and a state shown in FIG. 10(B) is changed into a state shown in FIG. 10(C). Accordingly, the threading hook 56*a* is returned to an original position with the upper thread A caught thereon and the upper thread A is inserted through the needle eye N.

Figure 11B:
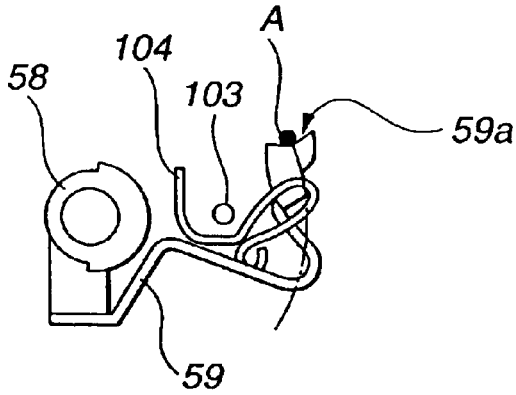
Figure 11C:
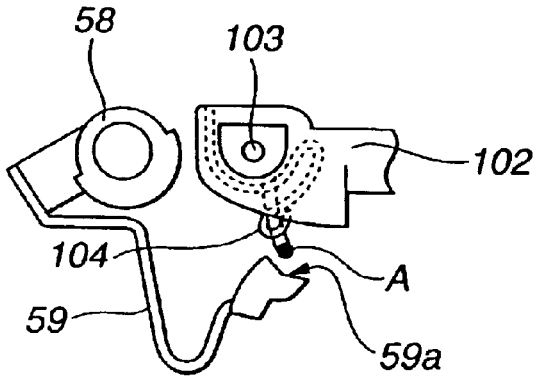

Moreover, when the threading operating member 52 goes up, the pin 52*c* provided on the lower end of the threading operating member 52 also goes up. Consequently, the needle damp thread guiding member 58 is correspondingly rotated reversely. Thus, a state shown in FIG. 11(B) is changed into a state shown in FIG. 11(C) and the needle damp thread guiding arm 59 is returned to an original position so that the upper thread A remains in the needle damp thread guide 104.

Furthermore, when the threading operating member 52 goes up and the pin 52*c* is moved to the uppermost part of the groove cam 58*a*, the needle damp thread guiding member 58 also goes up with a rise in the threading operating member 52. Moreover, the threading shaft 56 also goes up by the tensile force of the tension spring 57. Correspondingly, the upper thread A led from above is disposed in the needle clamp thread guiding arm 59 as shown in FIG. 9.

Furthermore, when the internal operating member 15 goes up and the upper surface of the internal operating member 15 abuts on the upper surface of the external operating member 14 from below, the external operating member 14 also goes up with a rise in the internal operating member 15. Consequently, the thread transfer member 20 goes up along the regulating cam 5, and furthermore, the transfer cam 19 is started to be rotated counterclockwise. Correspondingly, the holding pressure switching roller 46 is moved along the outer peripheral edge of the cam 19*b* which is rotated counterclockwise.

Figure 7:
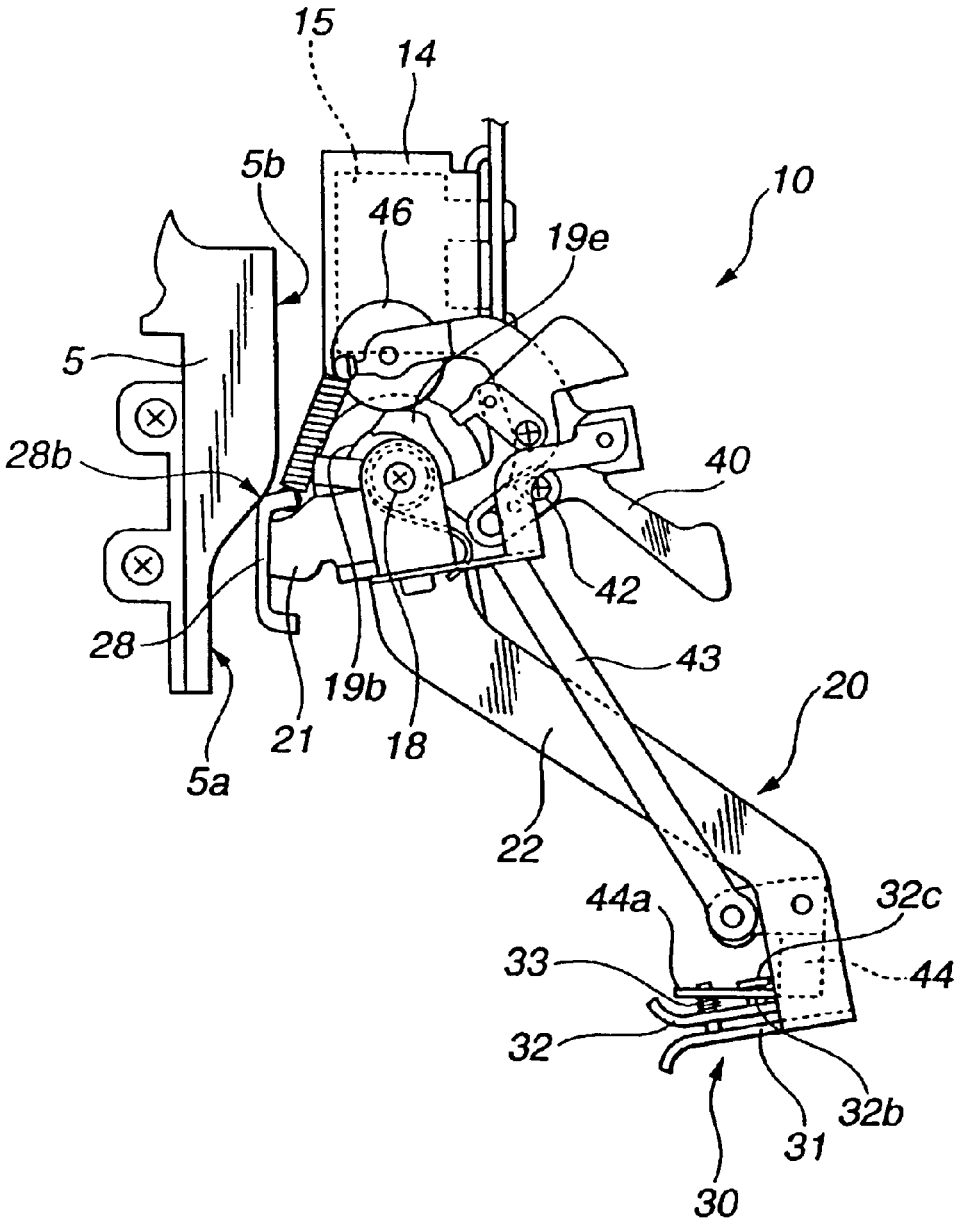
FIG. 7 is a side view showing a main part for explaining a state in which the thread transfer means in FIG. 1 comes back.

Furthermore, when the external operating member 14 goes up, the cam abutment portion 28 of the thread transfer member base portion 21 is moved toward the cam portion 5*b* side of the regulating cam 5 (as shown in FIG. 7). At this time, the holding pressure switching roller 46 gets over the protruded cam 19*e* and is moved in such a direction as to go away from the shaft 18.

Consequently, the positions of the holding pressure switching operating plate 40, the holding pressure switching adjusting plate 42, the holding pressure switching link 43 and the holding pressure switching plate 44 are moved and the end 44*a* is moved in such a direction as to separate from the fixing plate 31. Thus, the end 44*a* lifts the contact 32*c* toward the shaft 18 side. Therefore, the holding pressure of the thread holding portion 30 is almost eliminated. Accordingly, the upper thread reliably slips off from the thread holding portion 30 and is maintained to be inserted through the needle eye N.

Furthermore, when the internal operating member 15 and the external operating member 14 go up and the transfer member cam 19 is rotated counterclockwise in FIG. 7, the holding pressure switching roller 46 is moved from the cam face 19*g* to the cam face 19*f* along the inclined portion 19*h* of the transfer cam 19. At this time, the holding pressure switching roller 46 is pushed against the outer peripheral edge of the cam 19*c* by the tensile force of the tension spring 48. More specifically, the inclined portion 19*h* and the tension spring 48 are contact cam switching means for switching the cam with which the holding pressure switching roller 46 comes in contact.

Furthermore, when the transfer cam 19 is rotated counterclockwise, the stopper 19*d* of the transfer cam 19 abuts on the abutment portion 26*a* of the positioning plate 26 attached to the thread transfer member base portion 21. Consequently, the thread transfer member 20 is also rotated counterclockwise with the rotation of the transfer cam 19.

Then, if it is detected that the internal operating member 15 and the external operating member 14 goes up to the highest position in response to the signal of an origin detecting board which is not shown, the rotation of the driving shaft 11 by the stepping motor is stopped and the thread holding portion 30 is stopped in the thread holding position as shown in FIG. 2.

As described above, according to the thread guide device 1 for a sewing machine in accordance with the embodiment, the holding pressure switching roller 46 abuts on the cam 19*c* when the upper thread is to be transferred from the thread holding position in the upper part of the sewing machine to the needle eye N (during transfer), and the holding pressure switching roller 46 abuts on the cam 19*b* when the upper thread A is transferred to the needle eye N and the thread holding portion 30 is then returned to the upper part of the sewing machine (during return).

Consequently, the holding pressure of the thread holding portion 30 is increased during the transfer and the holding pressure is reduced during the return. Also in the case in which the upper thread A remains in the thread holding portion 30 after the thread is inserted through the needle eye N, therefore, it is possible to prevent the thread holding portion 30 from holding and pulling up the upper thread.

During the return, particularly, the holding pressure switching roller 46 gets over the protruded cam 19*e* so that the holding pressure of the thread holding portion 30 is almost eliminated. Therefore, the upper thread can be reliably removed from the thread holding portion 30.

Moreover, since the attachment position of the positioning plate 26 can be adjusted, it is possible to change the relative positions of the transfer cam 19 and the thread transfer member 20 in the state in which the stopper 19*d* is engaged with the abutment portion 26*a*. Consequently, since the stop position of the thread holding portion 30 can be adjusted in the state in which the internal operating member 15 is moved to the highest position, it can be set to such a position that the upper thread is easily led into the thread holding portion 30.

Moreover, the portion (the other end 28*b*) of the cam abutment portion 28 which abuts on the cam portion 5*b* of the regulating cam 5 is closer to the rotating shaft 18 of the thread transfer member 20 than the portion (the end 28*a*) to abut on the lower cam portion 5*a*. Therefore, the upper part of the regulating cam 5 can be provided closer to the thread transfer member 20 side and the size of the regulating cam 5 can be reduced.

In such a state that the thread transfer member 20 falls down to the lowermost part, moreover, the rotation of the thread transfer member 20 is regulated by the cam portion 5*a* in a position which is more distant from the shaft 18. Therefore, the rotation of the thread transfer member 20 can be stopped more stably. Consequently, the stop position of the thread holding portion 30 is stabilized and the upper thread is stretched before the needle eye N with higher precision so that precision in threading can be enhanced.

Moreover, since the attachment position of the holding pressure switching adjusting plate 42 can be regulated, the position of the fulcrum (the shaft 43*a*) of the holding pressure switching link 43 can be adjusted to regulate the holding pressure of the thread holding portion 30. Consequently, the holding pressure of the upper thread stretched before the needle eye N by the thread holding portion 30 can be properly regulated into a suitable holding pressure for the threading.

Furthermore, since the attachment position of the holding pressure switching abutment plate 6 can be adjusted, it is possible to regulate the holding pressure of the thread holding portion 30 when the internal operating member 15 is moved to the highest position. Consequently, the holding pressure of the thread holding portion 30 in the state in which the thread holding portion 30 is stopped in the thread holding position in the upper part of the sewing machine can be appropriately regulated into a proper holding pressure when setting the upper thread.

According to the invention, therefore, it is possible to carry out the thread guiding operation with higher precision.

The invention is not restricted to the embodiment but it is a matter of course that a structure, a shape and an arrangement can properly be changed.

For example, while the holding pressure switching adjusting plate 42 is attached to the middle portion 40*b* of the holding pressure switching operating plate 40, it may be attached to the other end 44*b* of the holding pressure switching plate 44, for example.

Moreover, the structure of the threading means 50 can be changed properly. For example, while the threading is carried out by the threading means 50 interlockingly with the vertical motion of the internal operating member 15 in the thread transfer means 10, it is also possible to employ such a structure that the threading means 50 independently carries out the threading operation for the upper thread without interlocking with the thread transfer means 10.

According to the first aspect of the invention, the holding pressure of the thread holding portion is increased such that the upper thread does not slip off from the thread holding portion during the transfer in which the upper thread is to be transferred from the thread holding position to the vicinity of the needle eye, and the holding pressure of the thread holding portion is reduced during the return in which the upper thread is to be transferred to the vicinity of the needle eye and the thread holding portion is to be then returned to the thread holding position. Also in the case in which the upper thread remains in the thread holding portion after the threading, consequently, the thread holding portion can be set so as not to hold and pull the upper thread. Thus, the thread guiding operation can be carried out with higher precision.

According to the second aspect of the invention, it is a matter of course that the same effects as those of the first aspect of the invention can be obtained. In addition, it is possible to switch the holding pressure of the thread holding portion with the rotation of the thread transfer member or the rotor.

According to the third aspect of the invention, it is a matter of course that the same effects as those of the second aspect of the invention can be obtained. In addition, it is possible to change the holding pressure of the thread holding portion during the transfer and the return by switching the cam with which the contact comes in contact.

According to the fourth aspect of the invention, it is possible to adjust the stop position of the thread holding portion. Consequently, the thread holding portion can be set into such a position that the upper thread can easily be held. Accordingly, the thread guiding operation can be carried out with higher precision.

According to the fifth aspect of the invention, the holding pressure of the thread holding portion can be finely adjusted by changing the fulcrum position of the link through the fulcrum position changing means. For example, accordingly, it is possible to regulate the holding pressure for the threading to be carried out by the threading means into a proper holding pressure. Thus, it is possible to carry out the thread guiding operation with higher precision.

According to the sixth aspect of the invention, the position of the contact can be determined into a different position, thereby regulating the holding pressure of the thread holding portion in the thread holding position into a suitable pressure for the thread holding. Accordingly, it is possible to carry out the thread guiding operation with higher precision.

According to the seventh aspect of the invention, the size of the regulating member can be reduced, and furthermore, the stop position of the thread holding portion in the vicinity of the needle eye can be determined with higher precision. Thus, it is possible to carry out the thread guiding operation with higher precision.

What is claimed is:

1. A thread guide device for a sewing machine comprising:

a needle;

a needle clamp having a thread guide for guiding an upper thread;

threading means for clamping the upper thread to the thread guide;

thread holding portion which is capable of holding an upper thread, and thread transfer means for transferring the upper thread to the vicinity of a needle eye by lowering said thread holding portion, wherein said threading means further comprising:

a needle clamp thread guiding member which guides the thread to the thread guide by rotating a thread guiding arm, said needle clamp thread guiding member being rotatable and positioned before an upper thread stretched from above by lowering the thread holding portion, and a thread guiding transmitting means for rotating the needle clamp thread guiding member so that the upper thread, being guided to the needle clamp thread guide, is clamped upon the needle clamp thread guide, further wherein after the thread holding portion is lowered beneath a position of the thread guiding arm, said needle clamp thread guiding member is rotated by driving the thread guiding transmitting means with a driving force that is commonly used for lowering the thread holding portion.

* * * * *